US006822124B2

(12) United States Patent
Pütter et al.

(10) Patent No.: US 6,822,124 B2
(45) Date of Patent: Nov. 23, 2004

(54) METHOD FOR PRODUCING ALCOXYLATED CARBONYL COMPOUNDS BY AN ANODIC OXIDATION METHOD USING A CATHODIC COUPLED REACTION FOR ORGANIC SYNTHESIS

(75) Inventors: Hermann Pütter, Neustadt (DE); Andreas Fischer, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/432,249

(22) PCT Filed: Nov. 22, 2001

(86) PCT No.: PCT/EP01/13587

§ 371 (c)(1),
(2), (4) Date: May 22, 2003

(87) PCT Pub. No.: WO02/42524

PCT Pub. Date: May 30, 2002

(65) Prior Publication Data

US 2004/0026263 A1 Feb. 12, 2004

(30) Foreign Application Priority Data

Nov. 24, 2000 (DE) ..... 100 58 304

(51) Int. Cl.[7] ..... C07C 47/02; C07C 69/66; C25B 1/00; C25B 3/00

(52) U.S. Cl. ..... 568/497; 568/591; 568/595; 568/618; 560/187; 205/343; 205/440

(58) Field of Search ..... 568/497, 591, 568/595, 618; 560/187; 205/343, 440

(56) References Cited

U.S. PATENT DOCUMENTS 4,450,055 A * 5/1984 Stafford ..... 204/78
4,648,948 A * 3/1987 Meshbesher ..... 205/343
5,223,102 A * 6/1993 Fedkiw et al. ..... 205/440

FOREIGN PATENT DOCUMENTS

DE 30 00 243 7/1981

OTHER PUBLICATIONS

K.D. Ginzel: "Indirect electrochemical alpha–methoxylation of aliphatic ethers and acetals" Tetrahedron, vol. 43, No. 24, pp. 5797–5805 1987.

* cited by examiner

*Primary Examiner*—Johann Richter
*Assistant Examiner*—Sikarl A. Witherspoon
(74) *Attorney, Agent, or Firm*—Oblon, Spivak, McClelland, Maier & Neustadt, P.C.

(57) ABSTRACT

A method for producing alcoxylated carbonyl compounds of general formula (I) (compounds I): $R^1{}_aR^2C(OR^3)_b$ wherein $R^1$, $R^2$ represent hydrogen or $C_1$–$C_6$-alkyl, $R^3$ independently means $C_1$–$C_6$-alkyl, a is 0 or 1, b 2 or 3 with the proviso that the sum of a and b is 3, by means of anodic oxidation of germinal dialcoxy compounds of general formula (II) (compounds II) wherein $R^4$, $R^5$, $R^6$, $R^7$ represent hydrogen or $C_1$–$C_6$-alkyl, $R^5$, $R^6$ represent $C_1$–$C_6$-alkyl or $C_1$–$C_6$-alcoxy, in the presence of a $C_1$–$C_6$-alkyl alcohol (compounds III). A usual compound (compound IV) is used as a cathodic depolarizer suitable for electrochemical oxidation. The anodic oxidation and cathodic reduction is carried out in an undivided electrolyte cell in the presence of $C_1$–$C_6$-alkyl alcohols.

II

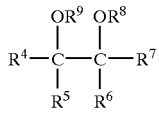

9 Claims, No Drawings

METHOD FOR PRODUCING ALCOXYLATED CARBONYL COMPOUNDS BY AN ANODIC OXIDATION METHOD USING A CATHODIC COUPLED REACTION FOR ORGANIC SYNTHESIS

The present invention relates to a process for preparing alkoxylated carbonyl compounds of the general formula I (compounds I)

$$R^1_aR^2C\ (OR^3)_b \qquad \text{I}$$

where $R^1$ and $R^2$ are each hydrogen or $C_1$–$C_6$-alkyl, $R^3$ is independently at each instance $C_1$–$C_6$-alkyl, a is 0 or 1 and b is 2 or 3, with the proviso that the sum total of a and b is 3, by anodic oxidation of geminal alkoxy compounds of the general formula II (compounds II)

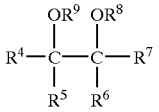

II where $R^4$, $R^5$, $R^6$ and $R^7$ are each hydrogen or $C_1$–$C_6$-alkyl and $R^5$ and $R^6$ are each $C_1$–$C_6$-alkyl or $C_1$–$C_6$-alkoxy, in the presence of a $C_1$–$C_6$-alkyl alcohol (compounds III), which comprises using a cathodic depolarizer comprising a customary organic compound (compounds IV) that is suitable for electrochemical reduction and conducting the anodic oxidation and the cathodic reduction in an undivided electrolytic cell in the presence of $C_1$–$C_6$-alkyl alcohols.

The preparation of organic compounds by concurrently utilizing the cathode reaction and the anode reaction has already been the focus of intensive research work on account of its particularly high energy efficiency (see M. M. Baizer, Organic Electrochemistry, 3rd Ed. (Eds. H. Lund and M. M. Baizer), Marcel Dekker, Chapter 35, New York 1991).

Although there are scientific papers (cf. Nonaka and Li, Electrochemistry, 67, 1999 Jan., 4–10, 1999) pointing out that there is in principle a multitude of coproduction possibilities, concrete industrial teaching is to be found in the scientific literature only for a few, and usually specific, examples.

Apart from a few mixtures (cf. DE-A-19618854) it has been determined that coproduction electrosynthesis is associated with technical disadvantages which rule out large scale industrial use in practice. These include in particular the difficult separation of the resulting reaction mixtures and also chemical reactions of reactants and products at the respective counterelectrodes, whereby the yield of the desired products of value is much reduced when the reaction is carried out in undivided electrolytic cells. The use of divided electrolytic cells would avoid these disadvantages, it is true, but these cell designs are very capital intensive. Especially in organic electrolytes, commercially available ion exchange membranes possess only very limited stability that rules out sustained industrial use.

J. Amer. Chem. Soc., (1975) 2546 and J. Org. Chem., 61 (1996) 3256 and Electrochim. Acta 42, (1997) 1933 disclose electrochemical processes whereby a C—C single bond between carbon atoms which each carry an alkoxy function can be oxidatively cleaved.

DE-A-10043789, unpublished at the priority date of the present invention, describes the production of orthoesters from alkoxylated diketones.

However, neither of the last two references cited suggests that these production processes might be useful in the realm of coproduction electrosynthesis.

It is an object of the present invention to provide a coproduction electrosynthesis process that combines the preparation of alkoxylated carbonyl compounds by anodic oxidation with the preparation of high value added organic compounds in a cathodic reduction and that does not have the aforementioned disadvantages of customary coproduction syntheses and, more particularly, provides the desired products of value in high yields.

We have found that this object is achieved by the process described above.

It is particularly favorable to use 1,2-di($C_1$–$C_6$-alkoxy) ethane or 1,2-di($C_1$–$C_6$-alkoxy)propane or 1,1,2,2-tetra ($C_1$–$C_6$-alkoxy)ethane or 1,1,2,2-tetra($C_1$–$C_6$-alkoxy) propane (compounds II). The compounds I produced in the process are the corresponding formaldehyde di($C_1$–$C_6$-alkyl) acetals or tri($C_1$–$C_6$-alkyl) orthoformates and in the case of the propane derivatives as starting materials likewise acetaldehyde di($C_1$–$C_6$-alkyl) acetals or tri($C_1$–$C_6$-alkyl) orthoacetates. The aforementioned acetaldehyde and acetic acid derivatives are likewise preparable from 2,3-di($C_1$–$C_6$-alkoxy)butane.

This is a particularly simple way of obtaining especially formaldehyde dimethyl acetal, trimethyl orthoformate, acetaldehyde dimethyl acetal and trimethyl orthoacetate from the corresponding compounds II and methanol.

As well as the aforementioned di- or tetraalkoxy ethane or -propane derivatives, useful compounds I and II include especially those where $R^4$ has the same meaning as $R^7$ and $R^5$ the same meaning as $R^6$ in order that the number of compounds in the reaction mixture to be worked up may be minimized.

Generally, alcohols will be used whose alkyl radicals have the same meanings as $R^8$ and $R^9$ or as the alkyl radicals in $R^5$ and $R^6$, provided $R^5$ and $R^6$ are each $C_1$–$C_6$-alkoxy.

Useful cathodic depolarizers are customary organic compounds that are suitable for anodic reduction, such as aromatic hydrocarbyl compounds, activated olefins, carbonyl compounds, aromatic carboxylic acids and derivatives thereof and also naphthalene or ring-substituted naphthalene derivatives.

The process of the invention is particularly useful for preparing the following compounds or classes of compounds:

a) maleic acid or maleic acid derivatives where the acid function is in the form of alkyl esters into tetraalkyl butanetetracarboxylates by hydrodimerization, b) benzenemono-, -di- or -tricarboxylic acids other than phthalic acid or phthalic acid derivatives, or benzenemono-, -di- or -tricarboxylic acid derivatives where the acid function is in the form of alkyl esters or derivatives substituted on the aromatic nucleus, into the corresponding mono-, di- and triformylbenzene compounds where the formyl groups are present in the form of an acetal, c) acrylic acid, alkyl acrylates, acrylamide or acrylonitrile or homologues thereof into the corresponding hydrodimerization products; preferred homologues are those of the general formula V $$R^{10}—CH=CH—X \qquad \text{V}$$

where X is an alkoxycarbonyl, nitrile or carbamide group and $R^{10}$ is $C_1$–$C_6$-alkyl, d) phthalic acid, alkyl phthalates or derivatives thereof substituted on the aromatic nucleus, into phthalide or ring-substituted phthalide derivatives, cyclohexane- or cyclohexene-1,2-dicarboxylic acid, dialkyl cyclohexane- or cyclohexene-1,2-dicarboxylates or derivatives substituted on the cyclohexane or cyclohexene ring in correspondence with the substitution pattern of the phthalic acid derivatives that are substituted on the aromatic nucleus, e) naphthalene or ring-substituted naphthalene derivatives into 1,2,3,4-tetrahydronaphthalene or the corresponding 1,2,3,4-tetrahydronaphthalene derivatives, f) pyridine or ring-substituted pyridine derivatives into 1,4-dihydropyridine or the corresponding 1,4-dihydropyridine derivatives.

Alkyl ester groups in reactants or products are in particular $C_1$–$C_6$-alkyl ester groups.

Useful substituents for substitution on the aromatic rings in the aforementioned starting compounds include inert, difficult-to-reduce groups such as $C_1$–$C_{12}$-alkyl, $C_1$–$C_6$-alkoxy or halogen.

As regards the phthalide or phthalide derivatives mentioned under point d), these are in particular compounds as described in DE-A-19618854.

Said reference likewise provides a more particular description of particularly suitable starting compounds.

The molar ratio of the starting compounds for cathode and anode reactions and also of the thereby formed products in the electrolytes relative to each other is uncritical.

Generally the molar ratio of the sum total of compounds I and II to the alcohols (compounds IV) will be in the range from 0.1:1 to 5:1, preferably in the range from 0.2:1 to 2:1, particularly preferably in the range from 0.3:1 to 1:1.

Conducting salts included in the electrolysis solution will generally be alkali metal, tetra($C_1$–$C_6$alkyl)ammonium or tri($C_1$–$C_6$-alkyl)benzylammonium salts. Useful counterions include sulfate, hydrogen sulfate, alkyl sulfates, alkyl sulfonates, halides, phosphates, carbonates, alkyl phosphates, alkyl carbonates, nitrate, alkoxides, tetrafluoroborate or perchlorate.

Useful conducting salts further include the acids derived from the aforementioned anions.

Preference is given to methyltributylammonium methosulfate (MTBS), methyltriethylammonium methosulfate or methyltripropylmethylammonium methosulfates.

The electrolysis solution may include customary cosolvents. These are inert solvents having a high oxidation potential which are generally customary in organic chemistry. Examples are dimethyl carbonate and propylene carbonate.

The process of the invention may be carried out in any customary undivided electrolytic cell type. It is preferable to operate a continuous process using undivided flowthrough cells. Stack plate cells having stack electrodes connected in series as described for example in DE-A-19533773 are particularly suitable.

The current densities used in the process are generally in the range from 1 to 1000 mA/cm$^2$, preferably in the range from 10 to 100 mA/cm$^2$. The temperatures are generally in the range from −20 to 60° C., preferably in the range from 0 to 60° C. The process is generally carried out at atmospheric pressure. Higher pressures are preferably reserved for the use of higher temperatures, in order that boiling of the starting compounds or cosolvents may be avoided.

Useful anode materials include for example noble metals such as platinum or metal oxides such as ruthenium or chromium oxide or mixed oxides of the $Ruo_xTio_x$ type. Preference is given to graphite or coal electrodes.

Useful cathode materials include for example iron, steel, stainless steel, nickel or noble metals such as platinum and also graphite or coal materials. Preference is given to a system utilizing graphite as anode and cathode and also graphite as anode and nickel, stainless steel or ordinary steel as cathode.

After the reaction is ended, the electrolyte solution is worked up by general methods of separation. For this, the electrolysis solution is generally first distilled and the individual compounds are obtained separately in the form of different fractions. Further purification may be effected for example by crystallization, distillation or chromatography.

It is unexpected that the anodic oxidation of compounds I to II in the presence of a cathodic production of a multiplicity of organic compounds in an undivided cell is accomplished in good yields because compounds I, acetals and orthoesters, are themselves reactive compounds.

EXAMPLE 1

An undivided cell has 11 annular disk electrodes each about 140 cm$^2$ in surface area and 14 cm in outer diameter, arranged in the form of a stack. Spacers are used to space the disks about 1 mm apart, so that there are 10 gaps between the annular disks. The electrode material is graphite. The inner disks, which are 0.5 cm in thickness, are connected in a bipolar series during electrolysis. The uppermost electrode is connected as the anode by means of a graphite plunger and a surface disk. The bottommost electrode is connected as the cathode via the base plate of the electrolytic cell. The electrolyte flows through the central hole in the base plate into the cell and then becomes distributed between the gaps and leaves the cell above the uppermost electrode. The cell is part of a loop apparatus in which the electrolyte is recirculated, heated or cooled.

975 g of tetramethoxyethane, 936 g of dimethyl maleate, 170 g of 60% methanolic solution of methyltributylammonium methosulfate and 419 g of methanol were electrolyzed using a current strength of 3 A. In the course of the electrolysis, the current strength decreased to 2.5 A and the voltage per gap rose from 5 V to 6 V.

Altogether, electrolysis was continued until the dimethyl maleate conversion was 95%. Temperature: 38° C., pumping rate: 183 l/h.

The electrolysis effluent contained 24.4% of methyl butanetetracarboxylate, 14.2% of trimethyl orthoformate, 25.6% of tetramethoxyethane and 1.7% of dimethyl maleate. The selectivity of orthoester formation was 82%. The composition of the electrolysis effluent was determined by gas chromatography and is reported in area percent (GC area %).

The current yield based on dimethyl maleate was 80%. Byproducts included dimethyl succinate and dimethyl 2-methoxysuccinate (sum total: 11%).

EXAMPLE 2

A cell as per Example 1 was used, the number of gaps being 7.

1062 g of tetramethoxymethane, 303 g of methyl benzoate, 225 g of 60% methyltributylammonium methosulfate solution and 910 g of methanol were electrolyzed at 3 A. The voltage per gap was kept below 5 V, the temperature was 30° C., and the pumping rate was 190 l/h. After the electrolysis had ended, 10.0 GC area % of trimethoxymethane and 13.2 GC area % of benzaldehyde dimethyl acetal had formed in the electrolyte; tetramethoxyethane had been degraded from 42.5% to 25.6 GC area %, and methyl benzoate was down to 0.4 GC area %, having been converted to more than 95%. Low-boiling byproducts included methyl formate at 2.2 GC area % in the electrolyte.

EXAMPLE 3

A cell as per Example 2 was used.

1200 g of tetramethoxymethane, 776 g of dimethyl o-phthalate, 166 g of 60% methyltributylammonium methosulfate solution in 385 g of methanol were electrolyzed at 2.6 A. The voltage per gap was maintained at 5.1–5.3 V, the temperature was 30° C. and the pumping rate was 170 l/h. Conversion was monitored via GC. After 2.4 F, corresponding to 120% of the theoretical current quantity, the tetramethoxymethane conversion was 66% and 28.4% of trimethoxymethane had formed in the solution, and the dimethyl o-phthalate conversion was 88%, it having been converted into phthalide at a selectivity of 90%.

EXAMPLE 4

The cell and the cell circuit have a similar construction to Example 1; 11 electrodes 65 mm in diameter and 31.6 $cm^2$ in surface area form 10 gaps.

229 g of tetramethoxymethane, 229 g of pentenenitrile and 28.8 g of 60% methyltributylammonium methosulfate solution in 114 g of methanol were circulated at a rate of 25 l/h at 23° C. and an 10 initial current strength of 1 A. The cell voltage was kept below 50 V, and the final current strength was 0.55 A.

The electrolysis was discontinued after 10 h, when 64% of tetramethoxyethane and 76% of pentenenitrile had been converted. Trimethyl orthoformate, methyl formate and formaldehyde dimethyl acetal had formed at the anode in a ratio of 1:0.17:0.1. The main products at the cathode were 3.4-diethyladiponitrile, pentanenitrile and 3-methoxypentanenitrile in a ratio of 1:0.3:0.8. A distillative workup provided the hydrodimerization 20 product of pentenenitrile, namely 3.4-diethyladiponitrile, in 97% purity.

What is claimed is:

1. A process for preparing formaldehyde di($C_1$- to $C_6$-alkyl) acetals, tri($C_1$- to $C_6$-alkyl) orthoformates, acetaldehyde di($C_1$- to $C_6$-alkyl) acetals or tri($C_1$- to $C_6$-alkyl) orthoacetates by anodically oxidizing 1,2-di($C_1$- to $C_6$-alkoxy)ethane or -propane, 1,1,2,2-tetra ($C_1$- to $C_6$-alkoxy)ethane or -propane, or 2,3-di-($C_1$- to $C_6$-alkoxy)butane in the presence of a $C_1$- to $C_6$-alkyl alcohol using a customary organic compound as a cathodic depolarizer which is suitable for electrochemical reduction, and performing the anodic oxidation and the cathodic reduction in an undivided electrolysis cell in the presence of $C_1$–$C_6$ alkyl alcohols.

2. The process as claimed in claim 1, wherein the formaldehyde di($C_1$- to $C_6$-alkyl) acetals, tri($C_1$- to $C_6$-alkyl) orthoformates, acetaldehyde di($C_1$-to- $C_6$-alkyl) acetals or tri($C_1$- to $C_6$-alkyl) orthoacetates are selected from are trimethyl orthoformate or formaldehyde dimethyl acetal and these compounds may also be formed in the form of a mixture.

3. The process as claimed in claim 1, wherein the organic compound is an aromatic hydrocarbon compound, activated olefin, aromatic carboxylic acid or derivative thereof, carbonyl compound, imine, heterocycle, naphthalene or core-substituted naphthalene derivative.

4. The process as claimed in claim 3, wherein the cathodic depolarization is one of the following conversions:

a) maleic acid or maleic acid derivatives in which the acid function is in the form of alkyl esters to a tetraalkyl butanetetracarboxylate by hydrodimerization b) benzenemono-, -di- or -tricarboxylic acids other than phthalic acid or phthalic acid derivatives, or derivatives of these compounds in which the acid function is in the form of alkyl esters or derivatives substituted on the aromatic core to the corresponding mono-, di- and triformylbenzene compounds in which the formyl groups are in the form of an acetal c) acrylic acid, alkyl acrylates, acrylamide or acrylonitrile or homologs of these compounds to the corresponding hydrodimerization products d) phthalic acid, alkyl phthalates or derivatives of these compounds substituted on the aromatic core to phthalide or core-substituted phthalide derivatives, cyclohexane- or cyclohexene-1,2-dicarboxylic acid, dialkyl cyclohexane- or cyclohexene-1,2-dicarboxylates, or derivatives substituted on the cyclohexane or cyclohexene ring corresponding to the substitution pattern of the phthalic acid derivatives substituted on the aromatic core e) naphthalene or core-substituted naphthalene derivatives to 1,2,3,4-tetrahydronaphthalene or the corresponding 1 ,2,3,4-tetrahydronaphthalene derivatives f) pyridine or core-substituted pyridine derivatives to 1,4-dihydropyridine or the corresponding 1,4-dihydropyridine derivatives.

5. The process as claimed in claim 1, which is carried out in a stacked plate cell using stacked electrodes connected in series.

6. The process as claimed in claim 2, which is carried out in a stacked plate cell using stacked electrodes connected in series.

7. The process as claimed in claim 3, which is carried out in a stacked plate cell using stacked electrodes connected in series.

8. The process as claimed in claim 4, which is carried out in a stacked plate cell using stacked electrodes connected in series.

9. The process as claimed in claim 2, wherein the organic compound is an aromatic hydrocarbon compound, activated olefin, aromatic carboxylic acid or derivative thereof, carbonyl compound, imine, heterocycle, naphthalene or core-substituted naphthalene derivative.

* * * * *